US007827911B2

(12) United States Patent
Kettinger et al.

(10) Patent No.: US 7,827,911 B2
(45) Date of Patent: Nov. 9, 2010

(54) METHOD FOR PRINTING ON TABLETS

(75) Inventors: Frederick R. Kettinger, Norristown, PA (US); Steven L. Yoder, Skippack, PA (US); Joseph D. Drost, Wales, PA (US)

(73) Assignee: BPSI Holdings, Inc., Wilmington, DE (US)

( * ) Notice: Subject to any disclaimer, the term of this patent is extended or adjusted under 35 U.S.C. 154(b) by 750 days.

(21) Appl. No.: 11/534,361

(22) Filed: Sep. 22, 2006

(65) Prior Publication Data

US 2007/0062385 A1 Mar. 22, 2007

Related U.S. Application Data

(60) Provisional application No. 60/719,732, filed on Sep. 22, 2005.

(51) Int. Cl.
*B41M 1/10* (2006.01)

(52) U.S. Cl. ..... 101/170; 101/163

(58) Field of Classification Search ..... 101/170
See application file for complete search history.

(56) References Cited

U.S. PATENT DOCUMENTS 2,182,559 A * 12/1939 Henderson ..... 359/893
2,482,638 A * 9/1949 Schultz et al. ..... 359/893
2,596,115 A * 5/1952 Lucien ..... 359/893
2,961,315 A * 11/1960 Stirling ..... 355/132
5,002,775 A 3/1991 Toya et al.
5,405,642 A 4/1995 Gilis et al.
5,436,026 A 7/1995 Berta
5,851,277 A 12/1998 Muller-Rees et al.
6,098,546 A * 8/2000 Schell ..... 101/492
6,113,945 A 9/2000 Jacobs et al.
6,113,954 A * 9/2000 Nauth et al. ..... 426/41
6,354,701 B2 * 3/2002 Korem ..... 347/106
6,776,341 B1 8/2004 Sullivan et al.
7,069,851 B2 * 7/2006 Shigeta ..... 101/170
7,580,154 B2 * 8/2009 Samworth ..... 358/3.06
2003/0103093 A1 * 6/2003 Vanhooydonck ..... 346/43
2004/0091594 A1 5/2004 Ackley, Jr. et al.
2004/0099159 A1 5/2004 Volder et al.
2005/0139100 A1 * 6/2005 Franz et al. ..... 101/170

* cited by examiner

*Primary Examiner*—Anthony H. Nguyen
(74) *Attorney, Agent, or Firm*—Lucas & Mercanti, LLP

(57) ABSTRACT

Method for printing on a pharmaceutical tablet by etching a printing plate to form a pattern of etchings therein within an area corresponding to an outline of the tablet, varying the ink-retaining volumes of the etchings in a pre-determined manner and in a direction across the etching pattern from one side to an opposite side, placing ink into the etchings, and transferring ink from the etchings in the etched printing plate onto an outer surface of the tablet. Variations in the ink-retaining volumes of the etchings cause a larger amount of ink to be transferred from etchings having a larger ink-retaining volume than from etchings having a smaller ink-retaining volume during the ink transfer stage. This causes different changes in the color of the outer surface of the tablet dependent on the amount of ink being transferred.

14 Claims, 3 Drawing Sheets

METHOD FOR PRINTING ON TABLETS

CROSS-REFERENCE TO RELATED APPLICATION

This application claims priority under 35 U.S.C. §119(e) of U.S. provisional patent application Ser. No. 60/719,732 filed Sep. 22, 2005, incorporated by reference herein.

FIELD OF THE INVENTION

The present invention relates generally to methods for printing on pharmaceutical tablets and more specifically to methods for printing on tablets to provide the tablets with a distinctive multi-colored or multi-hued appearance.

The present invention also relates to an etched printing plate for use in, for example, a pharmaceutical tablet printing method, and tablets produced by the method.

BACKGROUND OF THE INVENTION

Pharmaceutical tablets are typically made of a core of pharmaceutically active material, which is usually white, and a coating applied onto the core. The coating may be colored, i.e., contain ink of a certain color, in order to create uniformly colored tablets. Variations in colored tablets are limited in part by the number of colors potentially usable in coatings. This often leads to situations where different manufacturers have similarly colored tablets which are indistinguishable from one another.

Tablet manufacturers are constantly striving to produce a tablet which is distinguishable from other tablets and thus recognizable by consumers for the purpose of brand development and enhancement. To this end, tablet manufacturers create tablets having different shapes, sizes and appearances including irregular shapes and distinctive colors, and print unique logograms or indicia on the tablets. There are however limits to the sizes and shapes of tablets which can be created, the number of distinctive colors that can be created and the form and type of logograms and indicia that can be created.

The tablets are usually provided with specific colors, logograms and/or indicia in a printing stage. There are several possibilities for printing a medical tablet with ingestible ink. One common technique is pad printing wherein a printing plate is etched with the pattern sought to be printed onto the tablets, ink is placed into the etchings in the pattern and an elastic pad takes up the image from the printing plate and transfers it onto the surface of the tablet. Etched printing plates for use in this printing method, such as those sold by Printing International, Inc., include patterns of uniform etchings to provide a uniform application of the ink to the outer surface of the tablet. As a result, a uniform color is formed on the tablet.

It would therefore be desirable to enable tablets to be formed with color variations or gradients to provide the tablets with distinctive appearances.

OBJECTS AND SUMMARY OF THE INVENTION

It is therefore an object of the present invention to provide new and improved methods and arrangements for printing on pharmaceutical tablets.

It is another object of the present invention to provide new and improved methods and arrangements for printing on pharmaceutical tablets to provide them with a multi-color and/or multi-hue appearance.

It is yet another object of the present invention to provide new and improved methods and arrangements for printing on pharmaceutical tablets to provide them with a distinguishable color-based appearance which is capable of differentiated the printed tablets from other tablets printed in conventional ways.

It is still another object of the present invention to provide a new and improved etched printing plate for use in, for example, a pharmaceutical tablet printing method.

In order to achieve one or more of these objects and possibly others, a method for printing on a pharmaceutical tablet in accordance with the invention comprises etching a printing plate to form a pattern of etchings therein within an area corresponding to an outline of the tablet, varying the ink-retaining volumes of the etchings in a pre-determined manner and in a direction across the etching pattern from one side to an opposite side, placing ink into the etchings, and transferring ink from the etchings in the etched printing plate onto an outer surface of a core of the tablet. In view of variations in the ink-retaining volumes of the etchings in the etching pattern, during the ink transfer phase, a larger amount of ink is transferred from etchings having a larger ink-retaining volume than from etchings having a smaller ink-retaining volume. This causes different changes in the color of the outer surface of the tablet dependent on the amount of ink being transferred. Specifically, when more ink is transferred, the color of the ink will mask the color of the outer surface of the tablet causing the color of the ink to be visible, while on the other hand, when less ink is transferred, the color of the ink and the core of the outer surface of the table may be balanced resulting in the creation of one or more lighter shades or hues of the color of the ink. At parts of the etched printing plate where etchings are not present, and ink does not flow to the outer surface of the tablet during the ink transfer phase, the color of the outer surface of the tablet will be visible. Therefore, the outer surface of the tablet thus printed on can have multiple colors or hues, namely, the color of the ink, the color of the outer surface of the tablet which may be the color of the core of the tablet or the color of a pre-coating applied onto the core, and one or more composite colors formed from a combination of the color of the ink and the color of the outer surface of the tablet.

Appropriate selection of the color of the outer surface of the tablet, i.e., the color of the core or pre-coating, and the color of the ink enable the formation of numerous color, shade and/or hue variations which can be effectively used to aid in brand development and enhancement.

Variations in the ink-retaining volumes of the etchings in the etching pattern can be accomplished in several ways, which may be used independent of one another or in combination with one another. For example, the etchings can all be provided with a circular cross-section but have varying diameters, with the same or different depths, and/or with the same or different spacing therebetween. Spacing between the etchings preferably refers to the formation of the etchings with their centers at varying distances from one another. With etchings closer to one another, a higher concentration of etchings will be present within a given area so that a higher concentration of ink will be transferred therefrom to the outer surface of the tablet during the ink transfer phase.

Variations in the ink-retaining volumes of the etchings in a direction across the etching pattern can also be accomplished in several ways. One way provides a "fading" color appearance from one side of the tablet to the other and this is achieved by forming the etching pattern with discrete etching sections, each with a specific form of etching. An etching section on one side of the etching pattern has etchings with the largest ink-retaining volumes, another section on the opposite side of the etching pattern has etchings with the smallest ink-retaining volumes and one or more intermediate sections have etchings with intermediate ink-retaining volumes. In this manner, the amount of ink being transferred to the outer surface of the tablet varies gradually from one side of the table to the opposite side resulting in the darkest shade or hue of the color of the ink at one side, the lightest shade or hue of the color of ink at the opposite side and transition shades or hues in the middle.

Transfer of the ink from the etched printing plate to the outer surface of the tablet may be achieved using a pad printing process in which an elastic pad contacts the etched printing plate and receives the ink pattern therefrom and subsequently contacts the tablet to apply the ink to the tablet.

An arrangement for printing on a pharmaceutical tablet in accordance with the invention includes an etched printing plate as described above, an apparatus for placing ink into the etchings and a system for transferring ink from the etchings in the etched printing plate onto an outer surface of a core of the tablet. The transfer system can include an elastic pad arranged to contact the etched printing plate to receive ink therefrom and subsequently contact the tablet to apply the received ink to the tablet.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
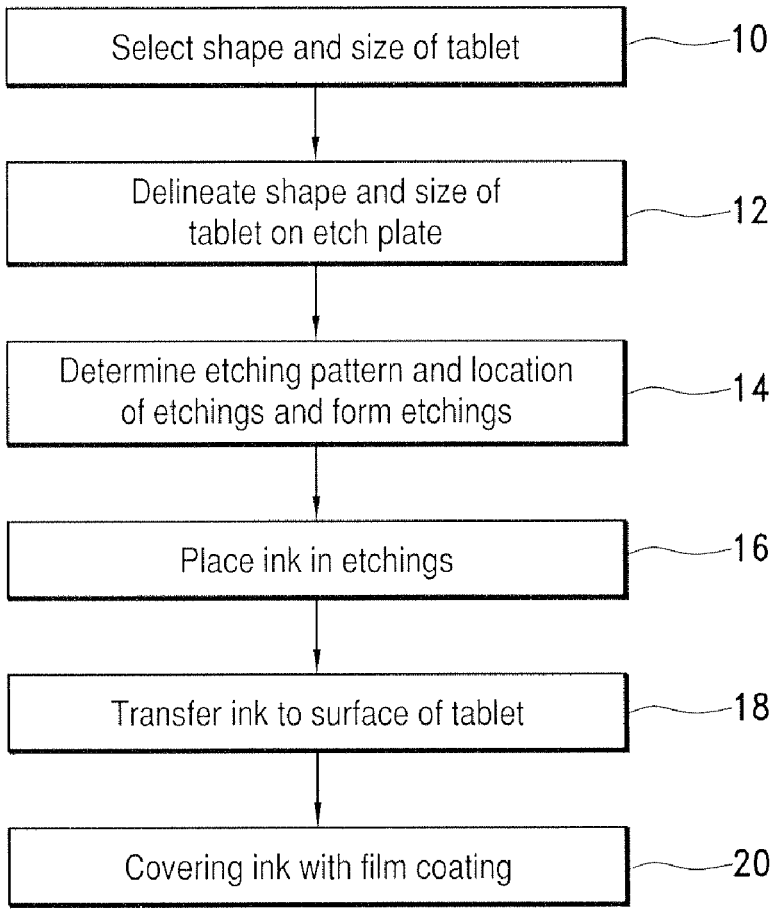
FIG. 1 is a flow chart of a method in accordance with the invention.

Referring to the accompanying drawings wherein like reference numerals refer to the same or similar elements, FIG. 1 is a flow chart showing the principal steps of an exemplifying method for printing on one or more tablets in accordance with the invention.

The first step 10 in the method is to select the shape and size of the tablets to be coated. The shape and size are essentially unlimited, the only limitations being those limitations relating to the fabrication of an etched printing plate, described below, and the capability of pharmaceutical tablet printing machines to accommodate the etched printing plates.

Figure 2:
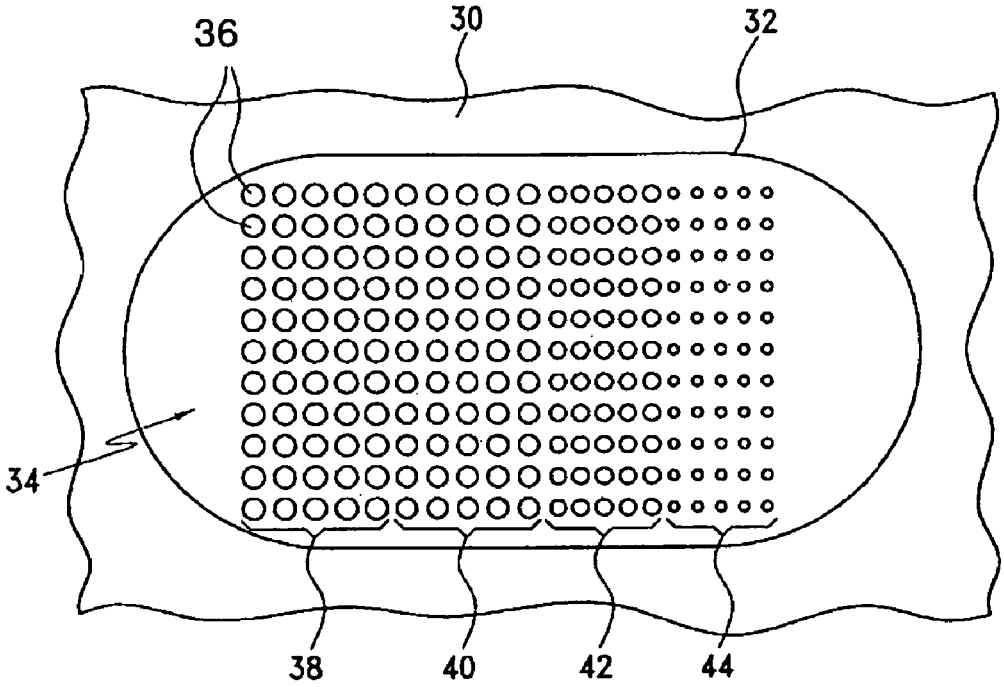
FIG. 2 is an illustration of part of a first embodiment of an etched printing plate showing an etching pattern in accordance with the invention.

The next step 12 is to delineate an outline of the selected shape and size of the tablet on a printing plate for the purpose of determining the pattern and locations of etchings to be formed thereon. For example, FIG. 2 shows an exemplifying portion of an etched printing plate 30 in accordance with the invention wherein an outline of the shape of the tablet on the substrate of the etched printing plate 30 is designated 32 and the pattern of etchings is designated 34. If the etched printing plate 30 is used to color individual tablets, it would include only a single etching pattern 34 within a single tablet outline 32. However, to expedite tablet production, a single etched printing plate 30 can be used to color multiple tablets simultaneously and to this end, the etched printing plate would include multiple patterns of etchings, each within a separate tablet outline. The patterns of etchings can be the same when the same size and shape tablets are being simultaneously colored, or even different if different size and shape tablets are sought to be colored simultaneously.

Tablet outline 32 may be considered to be for illustrative purposes only and is not required to be formed on the etched printing plate 30. Nevertheless, it must be insured that etching pattern 34 is formed only within the outline of a tablet which will correspond in both shape and size to a tablet being coated using the etching pattern 34.

The next step 14 in the method is to determine the etching pattern 34 and locations of the etchings 36 in the tablet outline 32, which determination is dependent on the final, desired color appearance sought for the tablet, and form the etchings 36 in the printing plate 30. Each etching 36 is a well or reservoir formed in the printing plate 30 and, in the illustrated embodiment, has a substantially circular cross-section and pre-determined depth. In contrast to conventional etched printing plates wherein etchings are essentially identical in both cross-sectional shape and depth and are arranged in a pattern the same distance apart, an etched printing plate in accordance with the invention is formed with substantially circular etchings having different diameters, different depths and/or which are arranged at varying distances from one another.

As shown in FIG. 2, four different etching sections 38, 40, 42, 44 are formed within the tablet outline 32 on etched printing plate 30. The first etching section 38 is on one side of the etching pattern 34 and has the largest diameter etchings 36 with the smallest distance between adjacent etchings and with the largest depth. The second etching section 40 has etchings with a smaller diameter than those in etching section 38, are spaced farther from one another than those in etching section 38 and have a depth less than the depth of those in etching section 38. The third etching section 42 has etchings with a smaller diameter than those in etching section 40, are spaced farther from one another than those in etching section 40 and have a depth less than the depth of those in etching section 40. The fourth etching section 44, on an opposite side of the etching pattern 34 from etching section 38, has etchings with a smaller diameter than those in etching section 42, are spaced farther from one another than those in etching section 42 and have a depth less than the depth of those in etching section 42. Thus, etchings in etching section 44 are the smallest, have the lowest depth and are spaced farthest from one another. When referring to the spacing between etchings 36 in the etching pattern 34 shown in FIG. 2, the centers of the etchings in all of the etching sections 38, 40, 42, 44 are in common rows but since the diameters of the etchings vary, the distance between the edge of one etching and the edge of an adjacent etching in the same etching section is larger as the size of the etchings decrease.

In view of their different diameters and depths, etchings 36 in each etching section 38, 40, 42, 44 have different ink-retaining volumes. Etchings 36 in the etching section 38 have the highest ink-retaining volume whereas etchings 36 in etching section 44 have the lowest ink-retaining volume. Etchings 36 in etching sections 40, 42 have intermediate ink-retaining volumes.

Figure 3:
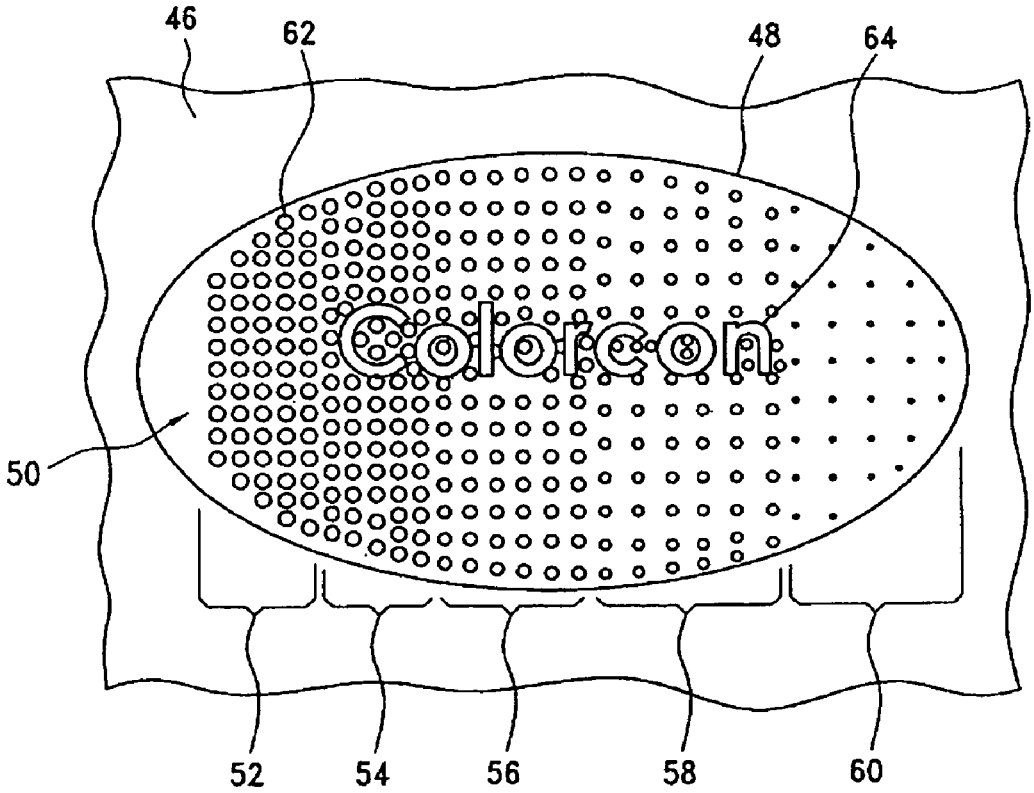
FIG. 3 is an illustration of part of a second embodiment of an etched printing plate showing an etching pattern in accordance with the invention.

The form of etching plate 30 shown in FIG. 2 is a non-limiting example of one such etched printing plate in accordance with the invention. Another etching plate 46 is shown in FIG. 3, wherein in addition to an etching pattern 48 within tablet outline 50 and having five discrete etching sections 52, 54, 56, 58, 60, each with different etchings 62, a word 64 is formed by forming the letters of the word 64 to be flush with the upper surface of the substrate of etched printing plate 46. In this manner, no ink is transferred to the tablet in the form of the word and thus the word will appear on the tablet, i.e., the word will appear in the color of the outer surface of the tablet being coated, whether it is the white of the core of the tablet or the color of a pre-coating applied to the core of the tablet.

Instead of a word 64, other indicia, such as logos, figures, trademarks, bar codes and registration marks, can be formed on the etched printing plate 46 by maintaining the indicia flush with the upper surface of the printing plate 46.

Referring again to FIG. 1 and with reference to the etched printing plate 30 shown in FIG. 2, once the etched printing plate 30 with an etching pattern 34 in accordance with the invention is formed, it can be used to color tablets using any of a variety of known tablet-printing techniques using etched printing plates, e.g., pad printing. Applying a basic technique, the method in accordance with the invention entails placing ink into the etchings (step 16), transferring the ink from the etchings to an outer surface of the tablet (step 18) and then applying a clear sealing coating over the ink to ensure the ink is retained on the tablet (step 20). If transfer of the ink from the etchings to the outer surface of the tablet is achieved using a pad printing process, an elastic pad would be brought into contact with the etched printing plate to receive an ink pattern therefrom and then subsequently brought into contact with the tablet to apply the ink to the tablet.

By virtue of the presence of etchings 36 having variable ink-retaining volumes, the transfer of ink from the etched printing plate 30 to the surface of the tablet is intentionally non-uniform. Indeed, it is the variation in the ink-retaining volumes of the etchings 36 which enables the formation of multi-colored and/or multi-hued tablets with distinctive color patterns in accordance with the invention.

Specifically, using the etched printing plate 30 shown in FIG. 2, ink will be transferred to the surface of the tablet with the highest concentration at and around etchings 36 in etching section 38 on one side of the tablet with an incrementally decreasing concentration until the lowest concentration will be at and around etchings 36 in etching section 44. This variation in ink transferred to the surface of the tablet, or variable pixelation density, causes different colors, shades, hues or gradients of the same color, to appear on the surface of the tablet. For example, when a single color ink is applied to the surface of a white core of the tablet, e.g., a blue ink, the shade of blue on the tablet will be darkest at the side of the tablet at which ink is transferred from etchings 36 in etching section 38 and lightest at the side of the tablet at which ink is transferred from etchings in etching section 44, with incremental shades or hues or blue therebetween. This results from the fact that there is more ink in etchings 36 in etching section 38 in view of their larger ink-retaining volume than in the etchings 36 in the other etching sections 40, 42, 44.

Figure 4:
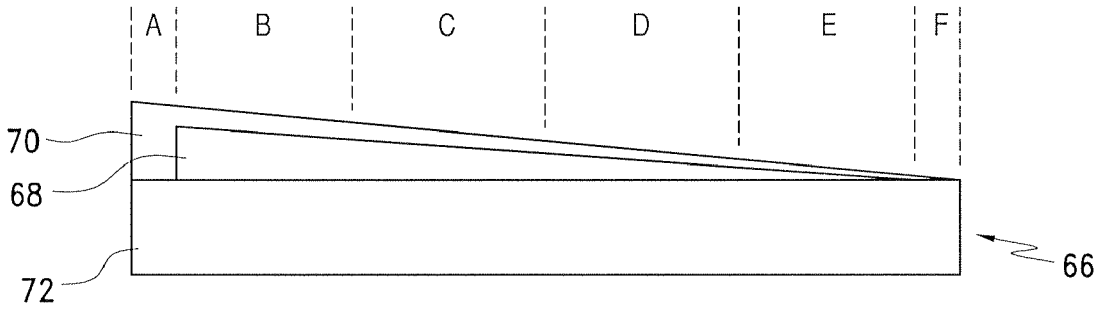
FIGS. 4-6 shows exaggerated cross-section views of tablets printed on using methods in accordance with the invention.

FIG. 4 shows an enlarged and exaggerated cross-section of a tablet 66 formed using etched printing plate 30. Ink layer 68 is shown with an exaggerated visible thickness to show the variation in the transfer of ink to the tablet, with more ink being transferred toward the left side than to the right side in view of the varying ink-retaining volumes of the etchings 36. Also, the sealing coating 70 is shown with a visible thickness which is also exaggerated.

For this example, it will be assumed that the color of the core is white and the ink color is blue. Accordingly, applying the method in accordance with the invention as described above, extreme left and right parts A, F of the tablet 66 have the color of the core 72, i.e., white. Part B, corresponding to that portion of the tablet 66 to which ink from etching section 38 has been transferred, is the darkest shade of blue. Part E, corresponding to that portion of the tablet 66 to which ink from etching section 44 has been transferred, is the lightest shade of blue. Parts C and D, corresponding to those portion of the tablet 66 to which ink from etching sections 40, 42 has been transferred, is each an intermediate shade of blue with part C being darker than part D.

Variations of the method described above are possible and envisioned to be within the scope of the invention. For example, as mentioned above, the ink can be transferred from the etched printing plate directly onto the core of the tablet, which is usually white, to thereby cause the color gradient to be formed in conjunction with the white color of the core (see the description of FIG. 4 above).

Alternatively, the white core of the tablet can be pre-coated with a colored coating and then printed using the etched printing plate 30 described above. In this case, a tablet can be formed with the appearance of three or more colors using only a single (pre-) coating process and a single printing process. For example, the white core of a tablet can be coated with a yellow coating and then printed with blue ink in the manner described above. In this manner, a multi-color appearance on the tablet will vary from blue (at locations where the concentration of ink is highest, i.e., those locations where the surface of the tablet receives ink transferred from etchings 36 in etching section 38) to green (at locations where the concentration of blue ink is balanced with the yellow coating, i.e., those locations where the surface of the tablet receives ink transferred from etchings 36 in etching sections 40, 42) to yellow (at locations where the concentration of blue ink is nominal or non-existent, i.e., those locations where the surface of the tablet receives ink transferred from etchings 36 in etching section 44).

Figure 5:
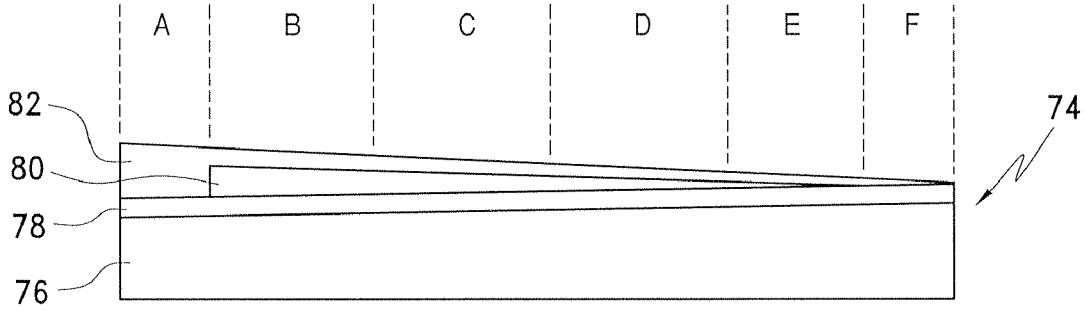

To illustrate this embodiment, FIG. 5 shows an enlarged and exaggerated cross-section of a tablet 74 formed using etched printing plate 30. A pre-coating layer 78, shown with an exaggerated thickness, is applied onto the core 76 of the tablet, e.g., by dipping. Ink layer 80 is shown with an exaggerated visible thickness to show the variation in the transfer of ink to the tablet, with more ink being transferred toward the left side than to the right side in view of the varying ink-retaining volumes of the etchings 36. Also, a sealing coating 82 is shown with a visible thickness which is also exaggerated.

For this example, it will be assumed that the color of the core is white, the color of the pre-coating layer is yellow and the color of the ink applied by transfer from the etch plate 30 is blue. Accordingly, applying the method in accordance with the invention as described above, extreme left and right parts A, F of the tablet 74 have the color of the pre-coating, i.e., yellow. Part B, corresponding to that portion of the tablet 74 to which ink from etching section 38 has been transferred, is the darkest shade of blue because the blue ink masks the yellow color of the pre-coating. Part E, corresponding to that portion of the tablet 74 to which ink from etching section 44 has been transferred, is yellow-green. Part C, corresponding to those portion of the tablet 74 to which ink from etching section 40 has been transferred, is primarily blue-green. Part D, corresponding to those portion of the tablet 74 to which ink from etching section 42 has been transferred, is primarily yellow-green. Since the different hues of the color are not demarcated, the actual colored appearance on the tablet 74 will appear as a continuous, seamless change across the color spectrum from blue to yellow on the tablet 74, with some portion in parts C and D where the blue ink balances the yellow coating being green.

Detailed design of the etching pattern 34 could thus yield a primarily three-colored tablet, i.e., with blue, green and yellow parts, obtained using only two colors, yellow as the color of the pre-coating and blue as the color of the printing ink.

An additional example would be if the core is blue and a red ink is used for printing. The color spectrum on the printed tablet would span blue, blue-purple, purple, red-purple and red. The same spectrum would be achieved if the core is red and the printing ink is blue.

To maximize the formation of different colors, shades and hues in accordance with the coloring scheme, complimentary colors should be used, i.e., the color of the pre-coating 78 should be complimentary to the color of the ink 80 to enable these colors to mix and form a discernible color (such as yellow and blue mixing to form green or blue and red mixing to form purple).

Another variation in the method is to apply two different color inks sequentially in the printing stage, each with a varying densities in a direction across the outer surface of the tablet, and adjacent a different side of the tablet.

Figure 6:
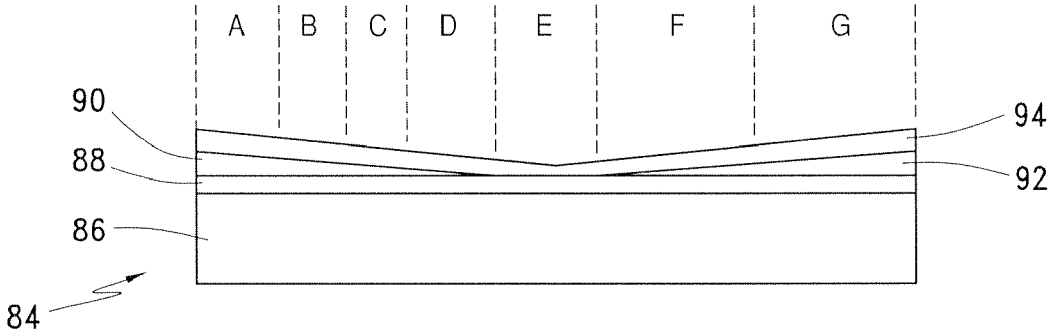

To illustrate this embodiment, FIG. 6 shows an enlarged and exaggerated cross-section of a tablet 84 formed using a pair of similar etched printing plates in accordance with the invention. A pre-coating layer 88, shown with an exaggerated thickness, is applied onto the core 86 of the tablet, e.g., by dipping. A first ink layer 90 on one side of the tablet 84 is shown with an exaggerated visible thickness to show the variation in the transfer of ink to the tablet, with more ink being transferred toward the left side than to the middle side in view of the varying ink-retaining volumes of the etchings in the printing plate. The first ink layer 90 is formed by applying ink from one of the etched printing plates to the tablet in the manner described above. The ink is placed into a first portion of the etchings adjoining one side of the etching pattern. A second ink layer 92 on the opposite side of the tablet 84, and being of a different color than the color of the first ink layer 90, is shown with an exaggerated visible thickness to show the variation in the transfer of ink to the tablet, with more ink being transferred toward the right side than to the middle side in view of the varying ink-retaining volumes of the etchings in the printing plate. The second ink layer 92 is formed by applying ink from the second etched printing plate to the tablet in the manner described above. For this etched printing plate, the ink is placed into a second portion of the etchings adjoining the opposite side of the etching pattern. Ink layers 90, 92 are therefore transferred to the tablet 84 in a two-step printing process using two etched printing plates. Also, a sealing coating 94 is shown with a visible thickness which is also exaggerated, and which is applied after the two ink layers 90, 92.

For this example, it will be assumed that the color of the core is white, the color of the pre-coating is yellow (although the same effect is achieved if the core itself is yellow and thus the pre-coating eliminated), the color of the first ink layer 90 is blue and the color of the second ink layer 92 is orange. Accordingly, applying the method in accordance with the invention as described above, extreme left part A of the tablet 84 will be blue because the blue ink masks the yellow color of the pre-coating, extreme right part G will be orange because the orange ink masks the yellow color of the pre-coating and intermediate part E will be yellow since ink layers 90, 92 do not cover it. Part C will be green because the blue ink layer 90 balances the yellow pre-coating 88. Part B will be in the color spectrum between blue and green, i.e., blue-green, while part D will be in the color spectrum between green and yellow, i.e., yellow-green. Part F will be in the color spectrum between yellow and orange, i.e., yellow-orange. Since the different hues of the color are not demarcated, the actual colored appearance on the tablet 84 will appear as a continuous, seamless change across the color spectrum from blue to green to yellow to orange.

Alternatively, if the core or the pre-coating layer is red, the colored appearance on the tablet 84 will appear as a continuous, seamless change across the color spectrum from blue to purple to red to orange.

The above-described printing methods can be used in combination with other printing techniques to provide unique printing methods, all of which are considered part of the invention. For example, variations to the method include varying the gloss intensities of the inks used in the method, using pearlescent color shifting coating systems and ink printing systems, using ultraviolet and/or infrared inks and coatings, forming the etching patterns in the form of bar codes or otherwise applying bar codes to an opposite surface of the table from the multi-colored appearance provided by the method in accordance with the invention, using translucent inks, using single-color or multi-colored compressed cores, forming faceted dosage shape designs, creating three-dimensional logo imprinted designs, creating high-definition printed embossed or debossed tablet highlights, using a combination of embossed and debossed tablet designs, using high-definition printing with embossed and debossed shape designs, and using high-definition printed logos with shadows to provide a three-dimensional effect. All of these options can be applied to an ink jet printing method or off-set rotogravure printing, to the extent possible.

Of interest, if a multi-colored core is used, then the number of possible color, shade and hue variations increases as different portions of the tablets will mix with the color of the ink in different ways.

Figure 7:
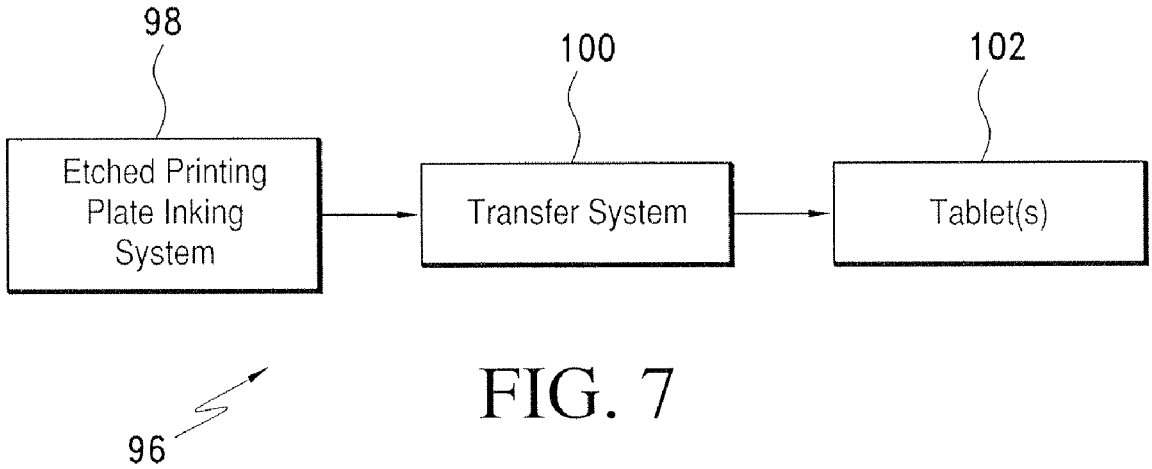
FIG. 7 is a diagram showing an arrangement for printing on tablets in accordance with the invention

Referring now to FIG. 7, the arrangement 96 in accordance with the invention which is capable of creating multi-colored or multi-hued tablets in any of the ways described above includes a system 98 for placing ink into the etchings in one or more of the etched printing plate 30 described above. This system 98 may be any known system for inking a printing plate and if multiple colors of ink are used, can be used to ink the printing plate with all of the colors. The arrangement 96 also includes a system 100 for transferring ink from the etchings in the etched printing plate(s) onto an outer surface of a core of one or more tablets 102 in the manner described above. Arrangement 96 may be based on a pad printing technique. In this case, the transfer system 100 may include one or more elastic pads each arranged to contact a respective one of the etched printing plates to receive ink therefrom and subsequently contact the tablet 102 to apply the received ink to the tablet. Other ink transfer systems known to those skilled in the art are also envisioned as part of the invention.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. For example, although reference is made above to methods and arrangements for printing on pharmaceutical tablets, the methods and arrangements in accordance with the invention described above are equally applicable to printing onto edible, non-pharmaceutical pieces such as confectionery products.

The invention claimed is:

1. A method for printing on a pharmaceutical tablet, comprising:

providing an etched printing plate having a pattern of etchings within an area corresponding to an outline of the tablet and which etchings have ink-retaining volumes that vary in a direction across the etching pattern, the ink-retaining volume of each of a plurality of etchings in a first region of the etching pattern is different than the ink-retaining volume of each of a plurality of etchings in a second region of the etching pattern that is spaced apart from the first region in the direction across the etching pattern, the ink-retaining volume of all of the etchings in the first region being the same and the ink-retaining volume of all of the etchings in the second region being the same;

placing ink into the etchings;

transferring ink from the etchings in the etched printing plate onto an outer surface of a core of the tablet with a larger amount of ink being transferred from etchings having a larger ink-retaining volume than from etchings having a smaller ink-retaining volume, the ink causing variable changes in the color of the outer surface of the tablet in the direction across the etching pattern dependent on the amount of ink being transferred from the etchings onto the outer surface of the core of the tablet;

coating a core of the tablet with a coating of a first color before ink in the etchings is transferred onto the outer surface of the tablet; and selecting the colors of the coating and the ink to cause at least three colors to be formed on the tablet, a first color being the color of the coating at locations where ink is not transferred to the outer surface of the tablet, a second color being the color of the ink at locations where the volume of ink masks the color of the coating and at least one additional color being a composite color of the color of the ink and the color of the coating at locations where ink is transferred to the outer surface of the tablet but does not mask the color of the coating.

2. A method for printing on a pharmaceutical tablet, comprising:

providing an etched printing plate having a pattern of etchings within an area corresponding to an outline of the tablet and which etchings have ink-retaining volumes that vary in a direction across the etching pattern, the ink-retaining volume of each of a plurality of etchings in a first region of the etching pattern is different than the ink-retaining volume of each of a plurality of etchings in a second region of the etching pattern that is spaced apart from the first region in the direction across the etching pattern, the ink-retaining volume of all of the etchings in the first region being the same and the ink-retaining volume of all of the etchings in the second region being the same;

placing ink into the etchings;

transferring ink from the etchings in the etched printing plate onto an outer surface of a core of the tablet with a larger amount of ink being transferred from etchings having a larger ink-retaining volume than from etchings having a smaller ink-retaining volume, the ink causing variable changes in the color of the outer surface of the tablet in the direction across the etching pattern dependent on the amount of ink being transferred from the etchings onto the outer surface of the core of the tablet; and selecting the colors of the core of the tablet and the ink to cause at least three colors to be formed on the tablet, a first color being the color of the core of the tablet at locations where ink is not transferred thereto, a second color being the color of the ink at locations where the volume of ink masks the color of the core of the tablet and a third color being a composite color of the color of the ink and the color of the core of the tablet at locations where the volume of ink balances the color of the core of the tablet.

3. The method of claim 2, further comprising applying a sealing coating over the ink to retain the ink in the tablet.

4. The method of claim 2, further comprising forming the core of the tablet in multiple, different colors.

5. The method of claim 2, further comprising providing an additional etched printing plate with the same pattern of etchings, the step of placing ink into the etchings comprising placing different color inks into the etchings in the two etched printing plates with the ink in one etched printing plate being placed into a first portion of the etchings adjoining one edge of the etching pattern and the ink in the other etched printing plate being placed into a second portion of the etchings adjoining an opposite edge of the etching pattern.

6. A method for printing on pharmaceutical tablets, comprising:

providing an etched printing plate having a plurality of separated patterns of etchings, each etching pattern being within an area corresponding to an outline of a tablet, ink-retaining volumes of the etchings in each etching pattern of the etched printing plate varying in a direction across the etching pattern, the ink-retaining volume of each of a plurality of etchings in a first region of each etching pattern is different than the ink-retaining volume of each of a plurality of etchings in a second region of the etching pattern that is spaced apart from the first region in the direction across the etching pattern, the ink-retaining volume of all of the etchings in the first region being the same and the ink-retaining volume of all of the etchings in the second region being the same;

placing ink into the etchings;

transferring ink from the etchings in the etched printing plate onto an outer surface of cores of the tablets with a larger amount of ink being transferred from etchings having a larger ink-retaining volume than from etchings having a smaller ink-retaining volume, the ink causing variable changes in the color of the outer surfaces of the tablets in the direction across the etching pattern dependent on the amount of ink being transferred from the etchings onto the outer surface of the core of the tablet; and selecting the colors of the core of the tablet and the ink to cause at least three colors to be formed on the tablet, a first color being the color of the core of the tablet at locations where ink is not transferred thereto, a second color being the color of the ink at locations where the volume of ink masks the color of the core of the tablet and a third color being a composite color of the color of the ink and the color of the core of the tablet at locations where the volume of ink balances the color of the core of the tablet.

7. The method of claim 2, wherein the etchings have a circular cross-section having varying diameters.

8. The method of claim 2, wherein the etchings have variable depths whereby the etchings with larger diameters are also deeper.

9. The method of claim 2, wherein the etchings have centers at varying distances from one another.

10. The method of claim 2, wherein the etchings have variable depths.

11. The method of claim 2, wherein the etchings have centers at varying distances from one another.

12. The method of claim 2, further comprising arranging etchings with the largest ink-retaining volumes at a first edge of the etching pattern, arranging etchings with the smallest ink-retaining volumes at a second, opposite edge of the etching pattern and incrementally varying the ink-retaining volumes of the etchings from the first edge to the second edge of the etching pattern.

13. The method of claim 2, further comprising arranging etchings with the largest ink-retaining volumes on first and second opposite edges of the etching pattern, arranging etchings with the smallest ink-retaining volumes in a middle of the etching pattern and incrementally varying the ink-retaining volumes of the etchings from the first and second edges to the middle of the etching pattern.

14. The method of claim 2, further comprising delineating an outline corresponding to the shape and size of the tablet on the etched printing plate, the etchings being formed within the outline of the tablet delineated on the etched printing plate.

* * * * *